US011999915B2

(12) United States Patent
Gul et al.

(10) Patent No.: US 11,999,915 B2
(45) Date of Patent: Jun. 4, 2024

(54) PHOSPHOROUS-FREE OIL SOLUBLE MOLYBDENUM COMPLEXES AS HIGH TEMPERATURE FOULING INHIBITORS

(71) Applicant: Ecolab USA Inc., St. Paul, MN (US)

(72) Inventors: Omer Gul, Rosenberg, TX (US); Oussama Zenasni, Houston, TX (US); Philip Andrew Thornthwaite, Wigan (GB)

(73) Assignee: ECOLAB USA INC., St. Paul, MN (US)

( * ) Notice: Subject to any disclaimer, the term of this patent is extended or adjusted under 35 U.S.C. 154(b) by 0 days.

(21) Appl. No.: 17/443,628

(22) Filed: Jul. 27, 2021

(65) Prior Publication Data

US 2022/0033977 A1 Feb. 3, 2022

Related U.S. Application Data

(60) Provisional application No. 63/058,023, filed on Jul. 29, 2020.

(51) Int. Cl.

*C10G 75/04* (2006.01)
*C10G 9/16* (2006.01)
*C23F 15/00* (2006.01)

(52) U.S. Cl.

CPC ..... *C10G 75/04* (2013.01); *C10G 9/16* (2013.01); *C23F 15/005* (2013.01)

(58) Field of Classification Search

CPC ..... C10G 9/16; C10G 75/04
See application file for complete search history.

(56) References Cited

U.S. PATENT DOCUMENTS 3,356,702 A 12/1967 Farmer et al.
3,446,735 A 5/1969 Weise
3,522,093 A 7/1970 Woolman
4,024,050 A 5/1977 Shell et al.
4,024,051 A 5/1977 Shell et al.
4,226,700 A 10/1980 Broom
4,298,454 A 11/1981 Aldridge et al.
4,370,221 A 1/1983 Patmore et al.
4,428,848 A 1/1984 Levine et al.
4,511,405 A 4/1985 Reed et al.
4,542,253 A 9/1985 Kaplan et al.
4,551,227 A 11/1985 Porter et al.
4,559,152 A 12/1985 Schlicht
4,582,543 A 4/1986 Bretz
4,613,372 A 9/1986 Porter et al.
4,941,994 A 7/1990 Zetlmeisl et al.
5,000,836 A 3/1991 Forester
5,015,358 A 5/1991 Reed et al.
5,055,174 A 10/1991 Howell et al.
5,182,013 A 1/1993 Petersen et al.
5,252,254 A 10/1993 Babaian-Kibala
5,314,643 A 5/1994 Edmondson et al.
5,445,749 A 8/1995 Hong
5,552,085 A 9/1996 Babaian-Kibala
5,630,964 A 5/1997 Babaian-Kibala et al.
5,863,415 A 1/1999 Zetlmeisl
6,022,835 A 2/2000 Fletcher
6,207,625 B1 3/2001 Ogano et al.
6,228,253 B1 5/2001 Gandman
6,258,760 B1 7/2001 Ozaki et al.
6,852,213 B1 2/2005 Tong
7,311,144 B2 12/2007 Conrad
7,727,942 B2 6/2010 Wormuth et al.
7,763,744 B2 7/2010 Tynik et al.
7,989,404 B2 8/2011 Habeeb et al.
8,092,618 B2 1/2012 Sharpe et al.
8,247,539 B2 8/2012 Revel et al.
8,309,041 B2 11/2012 Lott et al.
9,023,193 B2 5/2015 Koseoglu
9,090,837 B2 7/2015 Subramaniyam
9,115,319 B2 8/2015 Subramaniyam
9,206,361 B2 12/2015 Chabot et al.
9,233,359 B2 1/2016 Borremans et al.
9,605,215 B2 3/2017 Lott et al.
9,663,743 B2 5/2017 Griffin et al.
9,790,440 B2 10/2017 Chang
9,845,437 B2 12/2017 Savage et al.
9,890,339 B2 2/2018 Subramaniyam
9,951,290 B2 4/2018 Gao et al.
10,712,105 B1 7/2020 Christensen et al.
2007/0298505 A1 12/2007 Smith et al.
2009/0176671 A1 7/2009 Ozaki et al.
2010/0116718 A1 5/2010 Subramaniyam
2010/0152073 A1 6/2010 Nelson et al.
2010/0152074 A1 6/2010 Nelson et al.
2011/0160405 A1 6/2011 Subramaniyam
2014/0020645 A1 1/2014 Guinther et al.

(Continued)

FOREIGN PATENT DOCUMENTS

CN 1164867 A 11/1997
CN 101697038 A 4/2010

(Continued)

OTHER PUBLICATIONS

International Search Report for International Application No. PCT/US2021/043264, dated Nov. 10, 2021, 6 pages.
Written Opinion for International Application No. PCT/US2021/043264, dated Nov. 10, 2021, 11 pages.
De Feo, et al. (2017) "Formation of interfacial molybdenum carbide for DLC lubricated by MoDTC: Origin of wear mechanism", Wear, 370-371:17-28.
C. Grossiord, et al. (1998) "M0S2 single sheet lubrication by molybdenum dithiocarbamate", Tribology International, 31(12):737-743.
C. Grossiord, et al. (1998) "In situ MoS2 formation and selective transfer from MoDPT films", Surface and Coatings Technology, 108-109:352-359.
A. Morina, et al. (2006) "ZDDP and MoDTC interactions in boundary lubrication—The effect oftemperature and ZDDP/MoDTC ratio", Tribology International, 39:1545-1557.

(Continued)

*Primary Examiner* — Renee Robinson
(74) *Attorney, Agent, or Firm* — Kagan Binder, PLLC

(57) ABSTRACT

Disclosed are sulfur-containing molybdenum complexes used in compositions and methods for inhibiting or reducing the deposition of foulant on equipment.

6 Claims, 1 Drawing Sheet

(56) References Cited

U.S. PATENT DOCUMENTS

| | | | |
|---|---|---|---|
| 2014/0100148 | A1 | 4/2014 | Yagishita |
| 2016/0362619 | A1 | 12/2016 | Subramaniyam |
| 2017/0240838 | A1 | 8/2017 | Casey et al. |
| 2018/0100117 | A1 | 4/2018 | Flores-Torres et al. |
| 2019/0225909 | A1 | 7/2019 | Miller et al. |
| 2019/0264125 | A1 | 8/2019 | Iino et al. |
| 2021/0032528 | A1 | 2/2021 | Gul et al. |
| 2021/0032758 | A1 | 2/2021 | Zenasni et al. |
| 2022/0017836 | A1 | 1/2022 | Isa et al. |
| 2022/0033725 | A1 | 2/2022 | Zenasni et al. |
| 2023/0303908 | A1 | 9/2023 | Gul et al. |

FOREIGN PATENT DOCUMENTS

| | | | |
|---|---|---|---|
| CN | 104730602 | A | 6/2015 |
| CN | 105482869 | A | 4/2016 |
| CN | 106010480 | A | 10/2016 |
| DE | 2840094 | A1 | 3/1980 |
| EP | 0267674 | A1 | 5/1988 |
| EP | 0727429 | A2 | 8/1996 |
| EP | 0768366 | A1 | 4/1997 |
| EP | 1046700 | A2 | 10/2000 |
| EP | 1870706 | A1 | 12/2007 |
| EP | 2687582 | A1 | 1/2014 |
| EP | 2716743 | A1 | 4/2014 |
| JP | H0646243 | U | 6/1994 |
| WO | 96/06899 | A1 | 3/1996 |
| WO | 98/33869 | A1 | 8/1998 |
| WO | 2011/161982 | A1 | 12/2011 |
| WO | 2021/021888 | A1 | 2/2021 |
| WO | 2021021891 | A1 | 4/2021 |
| WO | 2022/026434 | A1 | 2/2022 |
| WO | 2022/026436 | A1 | 2/2022 |
| WO | 2020/105702 | A1 | 5/2022 |

OTHER PUBLICATIONS

O.P. Parenago, et al. (2017) "Sulfur-Containing Molybdenum Compounds as High-Performance Lubricant Additives (Review)", Petroleum Chemistry, 57(8):631-642.

T. Sakurai, et al. (1971) "The Synthesis of Di-μ-thio-dithio-bis(dialkyldithiocarbamates) Dimolybdenum (V) and Their Effects on• Boundary Lubrication", Bulletin of The Japan Petroleum Institute, 13(2):243-249.

R. Sarin, et al. (1994) "Molybdenum dialkylphosphorodithioates:synthesis and performance evaluation as multifunctional additives for lubricants", Tribology International, 27(6):379-386.

L. Yan, et al. (2012) "Comparing tribological behaviors of sulfur- and phosphorus-free organomolybdenum additive with ZDDP and MoDTC", Tribology International, 53:150-158.

Babaian-Kibala (1994) "Phosphate ester inhibitors solve naphthenic acid corrosion problems", Oil & Gas Journal, 92 (9), 9 pages, (Abstract).

International Search Report for International Application No. PCT/US2020/044009, mailed on Oct. 14, 2020, 7 pages.

Written Opinion for International Application No. PCT/US2020/044009, dated Oct. 14, 2020, 8 pages.

Oung et al. (1998) "Mitigating steel corrosion in cooling water by molybdate based inhibitors", Corrosion Prevention and Control. 45. 156-162 (Abstract only).

Written Opinion for International Application No. PCT/US2020/044005, dated Oct. 13, 2020, 8 pages.

International Search Report for International Application No. PCT/US2020/044005, dated Oct. 13, 2020, 6 pages.

International Search Report for International Application No. PCT/US2021/043267, dated Oct. 28, 2021, 6 pages.

Written Opinion for International Application No. PCT/US2021/043267, dated Oct. 28, 2021, 9 pages.

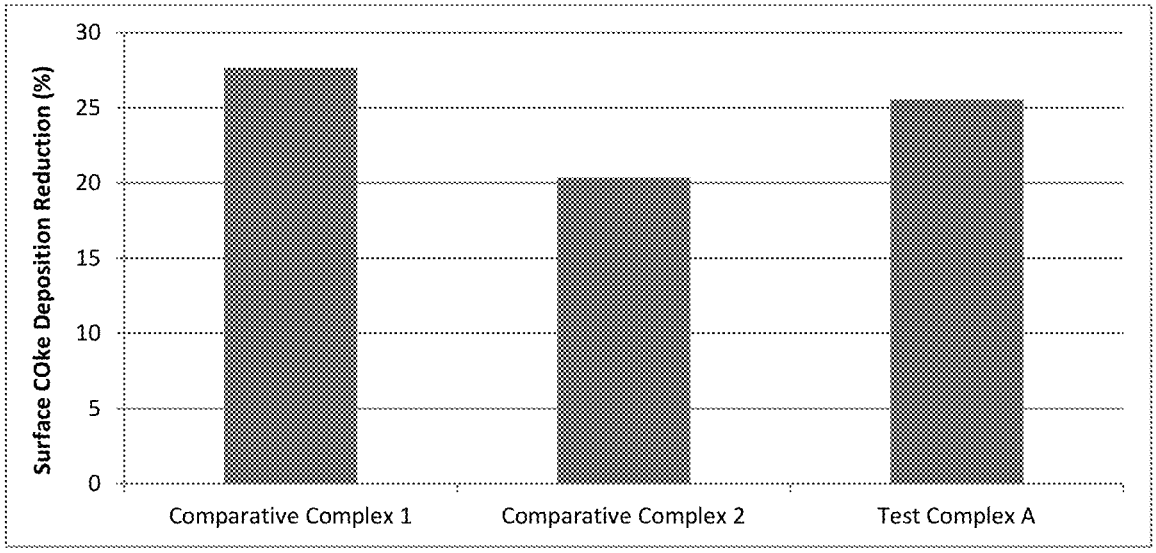
Surface COke Deposition Reduction (%)
30
25
20
15
10
5
0
Comparative Complex 1
Comparative Complex 2
Test Complex A

PHOSPHOROUS-FREE OIL SOLUBLE MOLYBDENUM COMPLEXES AS HIGH TEMPERATURE FOULING INHIBITORS

CROSS REFERENCE TO RELATED APPLICATIONS

This application claims the benefit of U.S. Provisional Patent Application Ser. No. 63/058,023, filed Jul. 29, 2020, the disclosure of which is incorporated in its entirety herein by reference.

FIELD

The application is directed at an anti-foulant composition.

BACKGROUND

The processes involved in petroleum and gas production, oil, gas, and petroleum refining, as well as petrochemical industries, for example, coking, visbreaking, reforming, hydroforming, absorption, isomerization, extraction, cracking, fractionation, hydrofining, desalting and the like, expose hydrocarbon streams to relatively elevated temperatures. The temperatures are most commonly attained by furnace heaters and heat exchangers in which the hydrocarbon feeds, products and intermediates are intimately contacted with heated surfaces. These conditions are known to promote the formation of deposits which can foul up various systems and processes. For example, foulant deposition can limit refining capacities and flow rates. The fouling in furnace heaters will cause heat transfer loss, hot spots throughout pipes, and metallurgy deformation issues. Fouling in heat exchangers will cause gradual efficiency loss, heat transfer loss, and pressure drop. These issues will reduce the throughput because of materials depositing on the inner surfaces thereof. Consequently, the process units must be periodically shut down and the deposits removed or the units replaced.

Coke is the typical foulant produced as a direct byproduct of polymerization and condensation reactions from lightest to heaviest fractions (maltenes, asphaltenes, and coke). Fouling is generally attributed to the presence of unstable components, such as thermally generated radicals, oxidized derivatives of hydrocarbons, the inorganic impurities present in hydrocarbon fractions, the presence of olefinic unsaturated hydrocarbons or their polymeric derivatives, or the like. Thus, almost all crude oil and fractions thereof, as well as process cuts prepared from such, contain reactive hydrocarbon constituents. Furthermore, almost all crude oil contains small amounts of dissolved oxygen, sulfur and metals, in a free and/or chemically combined state. If chemical and/or thermal treatment is involved, the reactive moieties in the hydrocarbon matrix may trigger the polymerization reactions.

Fouling of heat exchangers, and equipment such as furnaces, pipes, reboilers, condensers, compressors, auxiliary equipment, and the like, are costly because of the loss in production time and the increase in man hours required for disassembly, cleaning, and reassembly of the process equipment components.

SUMMARY

Disclosed are compositions and methods for inhibiting or reducing the deposition of foulant thereby improving energy efficiency of systems and preventing product quality issues.

In one aspect of the application is disclosed a method of inhibiting deposition of a foulant comprising:

introducing into a process equipment or a fluid in contact with the process equipment a composition comprising a sulfur-containing molybdenum complex having the general formula selected from Formula I or II:

Formula I

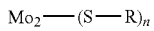

Wherein R represents an oxygen, nitrogen or carbon-containing compounds such as alcohols, alkyl, alkenyl, amides, amines, or aryl groups; n is 4-10.

Formula II

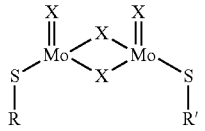

R and R' each represents an oxygen, nitrogen or carbon-containing compounds such as alcohols, alkyl, alkenyl, amides, amines, or aryl groups; and X represents oxygen or sulfur and can be the same or different but where at least one X in the formula is sulfur.

In another aspect is disclosed a composition a composition comprising sulfur-containing molybdenum complex to inhibit deposition of a foulant in contact with process equipment, the sulfur-containing molybdenum complex Formula I

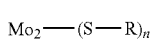

Wherein R represents an oxygen, nitrogen or carbon-containing compounds such as alcohols, alkyl, alkenyl, amides, amines, or aryl groups; n is 4-10.

Formula II

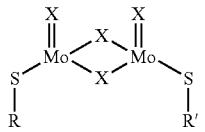

R and R' each represents an oxygen, nitrogen or carbon-containing compounds such as alcohols, alkyl, alkenyl, amides, amines, or aryl groups; and X represents oxygen or sulfur and can be the same or different but where at least one X in the formula is sulfur.

In still another aspect is treated process equipment comprising a process equipment comprising a metal surface; and the fluid source comprising a sulfur-containing molybdenum complex as described in Formula I, II, III, and IV, wherein at least a portion of the metal surface is contacted by the fluid source.

The sulfur-containing molybdenum complex is used to inhibit organic and inorganic material that deposit on equipment during the operation of a manufacturing and/or chemical process, which deposition may be unwanted and includes but is not limited to asphaltene and coke.

BRIEF DESCRIPTION OF THE DRAWINGS

FIG. 1 is a graphical representation of surface coke deposition in the presence of Test Complex A compared with Comparative Complex 1 and Comparative Complex 2.

DETAILED DESCRIPTION

Although the present disclosure provides references to embodiments, persons skilled in the art will recognize that changes may be made in form and detail without departing from the spirit and scope of the application. Reference to various embodiments does not limit the scope of the claims attached hereto. Additionally, any examples set forth in this specification are not intended to be limiting and merely set forth some of the many possible embodiments for the appended claims.

Publications, patents, and patent documents referred to in this application are incorporated by reference herein in their entirety as though individually incorporated by reference. If there are inconsistencies between this application and the documents incorporated by reference, the application controls and the incorporated documents are supplementary to the application.

As used herein, the term "anti-foulant" refers to a complex that prevents, retards, mitigates, reduces, controls and/or delays the deposition of organic and inorganic materials such as polymers, prepolymers, oligomers and/or other materials on "process equipment." The term will be understood to refer to the anti-foulant itself or in a composition which may include other anti-foulants or compounds or solvents, as determined by context.

As used herein, the term "foulant" means organic and inorganic material that deposit on equipment during the operation of a manufacturing and/or petroleum and/or chemical processes, which may be unwanted and which may impair the cost and/or efficiency of the process and includes but is not limited to asphaltene and coke.

As used herein, the term "hydrocarbon processing" means a process performed on the hydrocarbon material that includes but not limited to refining, storing, transporting, fractionating or otherwise affecting the hydrocarbon material.

As used herein, the term "inhibits," "inhibiting," or grammatical equivalents thereof refer to preventing, retarding, mitigating, reducing, controlling and/or delaying the deposition of foulant.

As used herein, the term "passivation" means the prevention of a reaction between two materials when used together by coating at least one of the two materials to such an extent that they become substantially less reactive relative to each other.

As used herein, the term "process equipment" means equipment used to refine, store, transport, fractionate, or otherwise process a material including but not limited to heaters, heat exchangers, tubes, pipes, heat transfer vessels, process vessels, tanks, compressors, fans, impellers, pumps, valves, inter-coolers, sensors, and the like, that are associated with a process and which may be subject to the deposition of foulant. This term also includes sets of components which are in communication such as, for example, a gas compressor in an ethylene cracking process.

As used herein, the term "optional" or "optionally" means that the subsequently described event or circumstance may, but need not occur, and that the description includes instances where the event or circumstance occurs and instances in which it does not.

As used herein, the term "about" modifying, for example, the quantity of an ingredient in a composition, concentration, volume, process temperature, process time, yield, flow rate, pressure, and like values, and ranges thereof, employed in describing the embodiments of the disclosure, refers to variation in the numerical quantity that can occur, for example, through typical measuring and handling procedures used for making compounds, compositions, concentrates or use formulations; through inadvertent error in these procedures; through differences in the manufacture, source, or purity of starting materials or ingredients used to carry out the methods, and like proximate considerations.

The term "about" also encompasses amounts that differ due to aging of a formulation with a particular initial concentration or mixture, and amounts that differ due to mixing or processing a formulation with a particular initial concentration or mixture. Where modified by the term "about" the claims appended hereto include equivalents to these quantities. Further, where "about" is employed to describe any range of values, for example "about 1 to 5" the recitation means "1 to 5" and "about 1 to about 5" and "1 to about 5" and "about 1 to 5" unless specifically limited by context.

As used herein, the word "substantially" modifying, for example, the type or quantity of an ingredient in a composition, a property, a measurable quantity, a method, a position, a value, or a range, employed in describing the embodiments of the disclosure, refers to a variation that does not affect the overall recited composition, property, quantity, method, position, value, or range thereof in a manner that negates an intended composition, property, quantity, method, position, value, or range. Examples of intended properties include, solely by way of non-limiting examples thereof, flexibility, partition coefficient, rate, solubility, temperature, and the like; intended values include thickness, yield, weight, concentration, and the like. The effect on methods that are modified by "substantially" include the effects caused by variations in type, number, or amount of materials used in a process, variability in machine settings, the effects of ambient conditions on a process, and the like wherein the manner or degree of the effect does not negate one or more intended properties or results; and like proximate considerations. Where modified by the term "substantially" the claims appended hereto include equivalents to these types and amounts of materials.

As used herein, any recited ranges of values contemplate all values within the range and are to be construed as support for claims reciting any sub-ranges having endpoints which are real number values within the recited range. By way of a hypothetical illustrative example, a disclosure in this specification of a range from 1 to 5 shall be considered to support claims to any of the following ranges: 1-5; 1-4; 1-3; 1-2; 2-5; 2-4; 2-3; 3-5; 3-4; and 4-5 and anything there between.

Described are compositions and methods to inhibit to the deposition of foulant in equipment and systems such as systems used in petroleum or hydrocarbon processing. The composition includes at least one sulfur-containing molybdenum complex. The sulfur-containing molybdenum complex contains at least one molybdenum center that is coordinated to at least a sulfur, and can include oxygen and bearing oxygen, nitrogen or carbon-containing ligands including, thiolates, sulfides, thiocarbamates, thiocarbonates, thioacids or polymers thereof and combinations thereof. The described compositions and methods inhibit fouling by serving as antifoulant, or to passivate a surface or both.

In some embodiments, the sulfur-containing molybdenum complex has the general formula of Formula I or Formula II.

Formula I $$Mo_2—(S—R)_n$$

Wherein Mo is molybdenum complex, S is sulfur, R represents oxygen, nitrogen or carbon-containing ligands such as alcohols, alkyl, alkenyl, amides, amines, or aryl groups; and n is 4-10.

Formula II

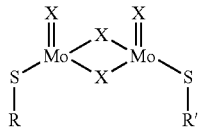

Wherein R and R' each represents oxygen, nitrogen or carbon-containing ligands such as alcohols, alkyl, alkenyl, amides, amines, or aryl groups, and R and R' can be the same or different; and X represents oxygen or sulfur and can be the same or different but where at least one X in the formula is sulfur.

In some embodiments, R or R' represents an alkyl group (linear, branched, or cyclic) with or without saturation or heteroatoms or both; thiolates, sulfides, thiocarbamates, thiocarbonates, thioacids, aromatic rings with or without substituents, organic polysulfides, or inorganic polysulfides (e.g., S2 through S8).

In some embodiments, R and R', are each an alkyl group having 2 to 30 carbon atoms; 5 to 20 carbon atoms; 5 to 15 carbon atoms; 5 to 10 carbon atoms or an aryl group (including alkylaryl group). In some embodiments the number of carbon atoms described above is characterized by one or more hydroxyl groups (e.g. alkyl alcohols), acids or esters thereof. In some embodiments, the alkyl group is ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, cyclohexyl, phenyl, naphthyl, tolyl, xylyl, benzyl and phenethyl groups. These alkyl groups may be primary, secondary or tertiary alkyl groups and straight-chain or branched. In some embodiments the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, dodecylphenyl groups, all of which alkyl groups may be primary, secondary or tertiary alkyl groups and straight-chain or branched. Furthermore, the (alkyl)aryl groups include all positional isomers wherein the aryl group may possess an alkyl substituent at any position. In some embodiments, the (alkyl) aryl groups as described above are composed of carbon and hydrogen, and might include heteroatoms such as nitrogen, oxygen, and sulfur.

In some embodiments, the alcohol groups may be monosubstituted alcohols, diols or bis-alcohols, or polyalcohols. In some embodiments the alcohols are six to ten carbon atoms.

In some embodiments, the amino groups may be monoamines, diamines, or polyamines. In some embodiments, the amine is a dialkyl amine with the formula HNR5R6, where R5 and R6 are each selected from straight or branched chains containing 2 to 24 carbon atoms, or from 4-13; 8 to 13; or 10 to 20 carbon atoms. R5 can be the same or different from R6. In some embodiments, the R5 and R6 can be an aryl group including an (alkyl)aryl group. In some embodiments the alkyl group is ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups. These alkyl groups may be primary, secondary or tertiary alkyl groups and straight-chain or branched. The alkyl groups may be straight-chain or branched and the alkyl groups may bond to any position of the phenyl groups, and mixtures thereof.

Other molybdenum complexes are sulfur-containing molybdenum dithiolates, molybdenum dithioester, or molybdenum thio-terminated amide complexes.

In some embodiments R and R' can be 1-4 rings or an aromatic group.

In some embodiments, the sulfur-containing molybdenum complex has the following general formula III:

Formula III

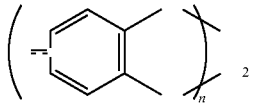

Wherein R is as described above. In some embodiments, the R is an alkyl group (linear, branched, or cyclic) with or without saturation or heteroatoms or both; thiolates, sulfides, dithiocarbamates, dithiocarbonates, dithioacids, aromatic rings with or without substituents, organic polysulfides, inorganic polysulfides; and n is 2-10 or 2-6.

In some embodiments the R in the sulfur-containing molybdenum is a phenolic containing sulfur. In some embodiments the phenolic containing sulfur is an ethylhexal phenol; 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide and 2,2'-thio-diethylenebis[3-(3,5-di-tert-butyl-4-hydroxyphenyl)propionate].

In some embodiments R and R' are each organic polysulfides or inorganic polysulfides. In some embodiments, the inorganic polysulfide has 2-10 or 2-8 or 3-7 sulfurs. In some embodiments the organic polysulfide has the general formula IV:

$$R^2—S_x—R^3$$ Formula IV

Wherein $R^2$ and $R^3$ are each as described above for R and R'. In some embodiments $R^2$ and $R^3$ are each an alkyl groups (aliphatic, acyclic, aromatic and heterocyclic groups) and R2 and $R^3$ can be the same or different; and x ranges from 2 to 8.

In some embodiments, the polysulfide is a di-(2ethylhexyl) polysulfide, dibenzylpolysulfide, di-tert-nonylpolysulfide, didodecylpolysulfide, di-tert-butylpolysulfide, dioctylpolysulfide, diphenylpolysulfide and dicyclohexylpolysulfide.

In other embodiments, the R, R' $R^2$ and $R^3$ are methyl, ethyl, n-propyl, isopropyl, n-butyl, isobutyl, sec-butyl, tert-butyl, pentyls, hexyls, heptyls, octyls, nonyls, decyls, dodecyls, cyclohexyl, phenyl, naphthyl, tolyl, xylyl, benzyl, phenethyl, ethylhexyl of thiolates, thiocarbamates, thiocarbonates, thioacids thereof and mixtures thereof.

In some embodiments the sulfur-containing Mo complex is as shown below.

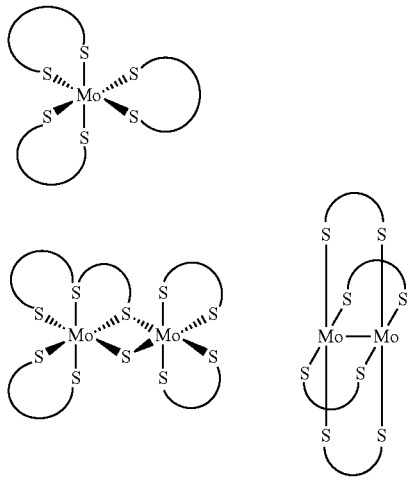

Wherein the arcs represent alkyl chains (linear, branched and cyclic) with or without saturation or heteroatoms or both; dithiocarbamates, dithiocarbonates, dithioacids, aromatic rings with or without substituents, organic polysulfides, or inorganic polysulfides.

In some embodiments the R, R', $R^2$ and $R^3$ in the sulfur-containing molybdenum complex are thiolates, thiocarbamates, thiocarbonates, thioacids, dithiolates, dithiocarbamates, dithiocarbonates, dithioacids, polymers thereof and mixtures thereof.

In some embodiments, the R, R', $R^2$ and $R^3$ in the sulfur-containing molybdenum complex is a diethyldithiocarbamate, dipropyldithiocarbamate, dibutyldithiocarbamate, dipentyldithiocarbamate, dihexyldithiocarbamate, dioctyldithiocarbamate, didecyldithiocarbamate, didodecyldithiocarbamate, di(butylphenyl)dithiocarbamate, di(nonylphenyl)dithiocarbamate, or di (2-ethylhexyl)dithiocarbamate or mixtures thereof.

In some embodiments, the sulfur-containing molybdenum complex is phosphorous-free or has little or no phosphorus. Such a complex provides a longer life for catalysts used in hydrocarbon-treating processes.

Any method known to one of skill in the art may be used to prepare the sulfur-containing molybdenum complexes. For example, the sulfur-containing molybdenum complex may be prepared as described in Tribology International Vol. 27, Issue 6, p. 379-386 (1994); Tribology International Vol. 53, p. 150-158 (2012); and U.S. Pat. No. 3,356,702, the references incorporated herein by reference in their entireties.

For example, molybdenum compounds of various oxidation states such as from 2-6 may be used and can be represented by the following compositions: molybdic acid, ammonium molybdate, molybdenum salts such as MoOC14, MoO2 Br2, Mo2 O3 Cl6, molybdenum trioxide or similar acidic molybdenum compounds. Acidic molybdenum compounds are molybdic acid, ammonium molybdate, and molybdenum trioxide. The molybdates include molybdenum oxide or molybdenum sulfide. The molybdates are reacted with a sulfur source. For example, the sulfur sources are sulfur, hydrogen sulfide, sulfur monochloride, sulfur dichloride, phosphorus pentasulfide, R2 Sx where R is hydrocarbyl, preferably C1-40 alkyl, and x is at least 2, inorganic sulfides and polysulfides such as (NH4)2 Sx, where x is at least 1, thioacetamide, thiourea, and mercaptans of the formula RSH where R is as defined above. Also useful as sulfurizing agents are traditional sulfur-containing antioxidants such as wax sulfides and poly sulfides, olefins, carboxylic and esters and ester-olefins, and alkylphenols and the metal salts thereof.

In some embodiments, the compositions comprise, consist essentially of, or consist of at least one of the described sulfur-containing molybdenum complexes. The sulfur-containing molybdenum complexes can be formulated as an anti-foulant or passivation composition useful to inhibit deposition of foulant (e.g., coke) on metal surfaces of process equipment in contact with a hydrocarbon material (in either liquid or gaseous form) which surfaces or liquid reach temperatures from 200° C. to 1500° C. In some embodiments the compositions comprise, consist essentially of, or consist of at least one of the described sulfur-containing molybdenum complexes to inhibit fouling by serving as antifoulant, or to passivate a surface or both.

In some embodiments, the sulfur-containing molybdenum complex is formulated with solvents such as water, alcohols such as methanol, ethanol, isopropanol, n-propanol, n-butanol, isobutanol, sec-butanol, t-butanol or higher alcohols such as benzyl alcohol); ketones such as acetone, or methyl ethyl ketone (2-butanone); acetonitrile; esters such as ethyl acetate, propyl acetate and butyl acetate; ethers such as diethyl ether or higher, e.g. methyl t-butyl ether, glyme, diglyme, ethylene glycol monobutyl ether, ethylene diglycol ethyl ether, 1,4 dioxane and related; aromatics such as toluene, xylene(s), diethylbenzene, naphthalene and related aromatics or refinery cuts (heavy aromatic naptha, heavy aromatic distillates, and related); aliphatics such as pentane, hexane, heptane, octane, or refined gasoline.

In some embodiments, the solvents suitable for formulation with the molybdenum-containing composition are aliphatic, such as pentane, hexane, cyclohexane, methylcyclohexane, heptane, decane, dodecane, and the like, and aromatics, such as toluene, xylene, heavy aromatic naphtha, diesel, fatty acid derivatives (acids, esters, amides), and the like.

In some embodiments the one or more solvents are 10 wt % to 99 wt % of the sulfur-containing molybdenum complex; 1-25 wt %; 20-50 wt %; 30-75 wt %; 50-75%; 75-100 wt % of the sulfur-containing molybdenum complex.

In some embodiments, the sulfur-containing molybdenum complexes are provided neat (viz., without a solvent). In some embodiments, the sulfur-containing molybdenum complexes are provided as a concentrate.

In some embodiments, the sulfur-containing molybdenum complex or compositions containing them include other additives such as one or more asphaltene inhibitors, paraffin inhibitors, scale inhibitors, demulsifiers, water clarifiers, dispersants, emulsion breakers, antifoams, or any combination thereof. In some embodiments, the sulfur-containing molybdenum complex further comprises one or more solvents or a mixture thereof.

While an effective amount of the sulfur-containing molybdenum complex used depends on a number of factors such as the local operating conditions, the hydrocarbon to be processed, the temperature and other characteristics of the process, in some embodiments, the sulfur-containing molybdenum complex or in compositions are used in an amount from about 0.1 ppm to 10,000 ppm; from 0.1 ppm to 3,000 ppm; from about 100 ppm to 1500 ppm; from about 100 ppm to 1000 ppm; from about 500 ppm to 3,000 ppm; from about 750 ppm to 3,000 ppm; from about 2,000 ppm to 5,000 ppm; from about 3,000 ppm to 5000 ppm; from about 100 ppm to 3,000 ppm; from about 1 ppm to 1000 ppm; from about 1 ppm to 3,000 ppm; from about 10 ppm to 50 ppm; from about 50 ppm to 100 ppm, from 100 pp to 800 ppm, from 150 ppm to 550 ppm; from about 1 ppm to 250 ppm; from about 1 ppm to 50 ppm; from about 1 ppm to 25 ppm; from about 1 ppm to 5 ppm; from about 3 ppm to 25 ppm; from 0.1 ppm to 5 ppm; or from about 0.1 ppm to 1 ppm by weight or volume of the sulfur-containing molybdenum complex in a fluid source.

The sulfur-containing molybdenum complex may be added by any suitable method. For example, the sulfur-containing molybdenum complex may be added neat or as a dilute solution. In some embodiments, the sulfur-containing molybdenum complex may be introduced as a solution, emulsion, or dispersion that is sprayed, dripped, poured or injected into a desired opening within a system or onto the process equipment or process condensate. In some embodiments, the sulfur-containing molybdenum complex may be added with a wash-oil or an at-temperation water.

The sulfur-containing molybdenum complex can be added continuously or intermittently to the process equipment as required to inhibit fouling. In some embodiments, the molybdenum-containing antifouling complex is introduced during or after a decoking or cleaning process such as an online spalling, mechanical pigging, or steam/air burning process. In some embodiments, the molybdenum-containing antifouling complex is introduced during a warm up process, viz., bringing the unit back to process temperatures after a shut down and/or cleaning process. In some embodiments, the sulfur-containing molybdenum complex is introduced to passivate the surfaces when the equipment is shut down and decoked and cleaned. In other embodiments, the sulfur-containing molybdenum complex is added and passivation can occur without shutting down the equipment. Any known method in the art to passivate surfaces can be used, such as for example U.S. Pat. No. 9,845,437, which reference is incorporated herein by reference in its entirety.

In some embodiments, the sulfur-containing molybdenum complex can be pumped or injected into a system in a continuous fashion or as an intermittent fashion to mitigate the fouling in the process unit. The injection point can be at any or all stages of the process unit.

The sulfur-containing molybdenum complex is used on any suitable process equipment such as process equipment used in the production and refining of oil and gas. In some embodiments, the process equipment includes thermal conversion units, heat exchanger, visbreakers, cokers, fired heaters, furnaces, fractionators, or other heat transfer equipment. In some embodiments the process equipment is gas compressors. In some embodiments, the process equipment is coils, heat exchangers, transfer line exchangers quench coolers, furnaces, separation columns or fractionators. The sulfur-containing molybdenum complex can also be useful in other similar applications and with other equipment. For example, the sulfur-containing molybdenum complex may be used with any process where process equipment will come into contact with unsaturated monomers, such as in an ethylene cracked gas process. Another application is ethylene and acrylonitrile quench water systems. The sulfur-containing molybdenum complex may be used with ethylene dilution steam generators and acrylonitrile purification systems. Many polymer processes have monomer recovery systems which are subject to fouling and are good target applications for the sulfur-containing molybdenum complex. Water strippers and waste water strippers used with petrochemical processes such as styrene, butadiene, acrylonitrile, and ethylene processes are potential applications for the sulfur-containing molybdenum complex. In some embodiments, ethylene acid gas scrubbers and butadiene solvent recovery systems are also end-use applications of the sulfur-containing molybdenum complex. The sulfur-containing molybdenum complex can be used in any process which has process equipment subject to foulant (e.g., polymers) forming and depositing on process equipment. In some embodiments, the sulfur-containing molybdenum complex can prevent polymerization and deposition of the polymers on process equipment in a primary fractionation process, light ends fractionation, non-aromatic halogenated vinyl fractionation, process-gas compression, dilution steam system, caustic tower, quench water tower, butadiene extraction. In some embodiments, the sulfur-containing molybdenum complex can inhibit the polymerization of resins and compositions comprising unsaturated species. In some embodiments, fouling is inhibited by using the sulfur-containing molybdenum complex to surface passivate processing equipment.

The sulfur-containing molybdenum complexes are not used in processing equipment such as an engine, hydraulic brake, power steering system, or transmission nor are the sulfur-containing molybdenum complexes used as a coolant additive in hydraulic fluid.

In some embodiments the sulfur-containing molybdenum complex is introduced into a fluid by any means suitable for ensuring dispersal of the sulfur-containing molybdenum complex through the fluid source being treated. The composition comprising the sulfur-containing molybdenum complex can be injected as prepared or formulated in one or more additional solvents, depending upon the application and requirements. One of skill in the art will understand that the methods disclosed herein are not limited in any way by the introduction method, the timing or the location of the introduction.

In some embodiments, the sulfur-containing molybdenum complex or in compositions is introduced to a fluid source using various well-known methods and they may be introduced at numerous, different locations throughout a given system. In one embodiment, the composition comprising the molybdenum-containing chemistry is pumped into an oil/gas pipeline using an umbilical line. In some embodiments, capillary string injection systems may be utilized to deliver the composition. U.S. Pat. No. 7,311,144 provides a description of an apparatus and methods relating to capillary injection, the disclosure of which is incorporated into the present application in its entirety. In other embodiments, the composition comprising the one or more sulfur-containing molybdenum complex is injected using mechanical equipment such as chemical injection pumps, piping tees, injection fittings, and the like.

In some embodiments the sulfur-containing molybdenum complex is introduced into process equipment or fluid in contact with the process equipment. In some embodiments, the process equipment is used to refine, store, transport, fractionate, or otherwise process a hydrocarbon such as crude oil, natural gas, petroleum and petroleum fractions.

The sulfur-containing molybdenum complex or in compositions is introduced into process equipment to form treated process equipment. In some embodiments, treated process equipment can be observed to undergo less foulant deposition than on process equipment without addition of the sulfur-containing molybdenum complex or in compositions.

Inhibition in the foulant formation or foulant deposition can be evaluated by any known method or test. In some embodiments, the inhibition of foulant formation and foulant deposition on process equipment can be assessed by measuring weight gain caused by foulant deposition as described in Examples 1 and 2.

The sulfur-containing molybdenum complex or in compositions can be used for any process equipment having a metal surface. In some embodiments, the metal surface of the process equipment is metal or metal alloys. For example, the metal surface can include steel (including carbon steel, stainless steel, galvanized steel, hot dipped galvanized steel, electrogalvanized steel, annealed hot dipped galvanized steel, or mild steel), nickel, titanium, tantalum, aluminum, copper, gold, silver, platinum, zinc, nickel titanium alloy (nitinol), an alloy of nickel, chromium, iron, iridium, tungsten, silicon, magnesium, tin, alloys of any of the foregoing metals, coatings containing any of the foregoing metals, and combinations thereof. In some embodiments, the metal surface of the process equipment is iron alloys, carbon steel, stainless steel, nickel-chromium-iron alloys, or other alloys.

In some embodiments, the deposition of foulant inside process equipment treated with the sulfur-containing molybdenum complex is reduced by at least 50 wt % compared to process equipment not treated with the molybdenum-containing foulant. In some embodiments, about 50 wt % to 100 wt % (where 100 wt % reduction in polymer formation is elimination of deposition), or about 50 wt % to 95 wt %, or about 50 wt % to 90 wt %, or about 50 wt % to 85 wt %, or about 50 wt % to 80 wt %, or about 50 wt % to 75 wt %, or about 50 wt % to 70 wt %, or about 55 wt % to 100 wt %, or about 60 wt % to 100 wt %, or about 65 wt % to 100 wt %, or about 70 wt % to 100 wt %, or about 60 wt % to 95 wt %, or about 70 wt % to 95 wt %, or about 60 wt % to 90 wt %, or about 70 wt % to 90 wt %. The effectiveness of the sulfur-containing molybdenum complex on reducing fouling can be assessed by measuring weight gain caused by foulant deposition as described in Examples.

The sulfur-containing molybdenum complexes are used in a method to passivate the surfaces of a process equipment to provide a treated process equipment. The treated process equipment mitigates (e.g., inhibits) the fouling on the metal surfaces. Examples of passivation are described in U.S. Pat. Nos. 4,024,050, 3,522,093, 6,228,253, ASTM A-967, and ASTM A-380, which references are incorporated herein by reference in their entirety. In some embodiments, passivation is carried out before the process equipment is used for a hydrocarbon processing (e.g., prior to hydrocarbon cracking) and/or after the process equipment has been de-coked or cleaned, and referred herein as pre-passivation.

In some embodiments, the sulfur-containing molybdenum complexes is introduced into the hydrocarbon feedstock before or during the processing of the hydrocarbon feedstock, and referred here as passivation. In the method to pre-passivate or passivate, in some embodiments, the molybdenum complex is introduced continuously or intermittently.

In some embodiments, the sulfur-containing molybdenum complexes are introduced at an initial dosage rate and for short time period to result in coating of the metal surface. In some embodiments, the sulfur-containing molybdenum complexes are introduced at a rate of about 1 ppm to about 3,000 ppm or about 500 ppm to about 2,000 ppm and to maintain this level for a time period ranging from 12 hour to 48 hours or 12 hours to 24 hours until the sulfur-containing molybdenum complexes induces the build-up of a protective coating (e.g., unreactive) on the metal surfaces. In other embodiments, the sulfur-containing molybdenum complexes is dosed at a concentration that is at least double the initial dosage rate for a period of 1 hour to 12 hours prior to introducing the fluids to be processed. In some embodiments, the sulfur-containing molybdenum complexes are introduced at a rate of about 1000 ppm to about 3,000 ppm for a time period ranging from 6 hour to 12 hours.

In other embodiments, the sulfur-containing molybdenum complexes is dosed at a concentration that is at least double the initial dosage rate for a period of 1 hour to several hours while simultaneously introducing fluids to be processed.

Once the protective surface is established, the dosage rate needed to maintain the protection may be reduced from 1 ppm to 3000 ppm to at least 1 ppm to 1500 ppm. In some embodiments the dosage for a continuous application of the sulfur-containing molybdenum complex into the fluid is 1 ppm to 1500 ppm; 1 ppm-1000 ppm; 1-500 ppm, 1-250 ppm, 100-200 ppm, or 500-1000 ppm without substantial sacrifice of protection.

In some embodiments, the sulfur-containing molybdenum complexes are used as disclosed in U.S. Provisional Application No. 63/058,010 filed Jul. 29, 2020.

Additional embodiments include:

1. A method of inhibiting deposition of a foulant comprising:

introducing into a process equipment or a fluid in contact with the process equipment a composition comprising a sulfur-containing molybdenum complex having the general formula selected from Formula I or II:

Formula I

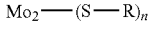

Wherein R represents an oxygen, nitrogen or carbon-containing compounds such as alcohols, alkyl, alkenyl, amides, amines, or aryl groups; n is 4-10.

Formula II

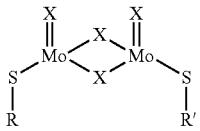

R and R' each represents an oxygen, nitrogen or carbon-containing compounds such as alcohols, alkyl, alkenyl, amides, amines, or aryl groups; and X represents oxygen or sulfur and can be the same or different but where at least one X in the formula is sulfur.

2. The method of embodiment 1, wherein the introducing is by injecting, spraying, or dripping the sulfur-containing molybdenum complex.

3. The method as in any one of embodiments 1-2, wherein the introducing is carried out after or during a decoking or cleaning or during a warm up process.

4. The method as in any one of embodiments 1-3, wherein the introducing is carried out during a hydrocarbon processing.

5. The method as in any one of embodiments 1-4, wherein the introducing is carried out intermittently.

6. The method as in any one of embodiments 1-4, wherein the introducing is carried out continuously.

7. The method as in any one of embodiments 1-6, wherein the process equipment comprises coils, heat exchangers, transfer line exchangers quench coolers, furnaces, separation columns or fractionators.

8. The method as in any one of embodiments 1-7, wherein the process equipment comprises iron or iron alloys.

9. The method as in any one of embodiments 1-8, wherein the iron alloys comprise carbon steel, stainless steel, or nickel-chromium-iron alloys.

10. The method as in any one of embodiments 1-9, wherein the foulant comprises coke, sludge, corrosion products, polymers, and catalyst fines.

11. The method as in one of embodiments 1-10, wherein the fluid comprises at least a liquid hydrocarbon material.

12. The method as in one of embodiments 1-11, wherein the sulfur-containing molybdenum complex is added to the fluid from 1 ppm to 3000 ppm of the fluid volume.

13. The method as in one of embodiments 1-12, wherein the sulfur-containing molybdenum complex further comprises one or more, asphaltene inhibitors, paraffin inhibitors, scale inhibitors, emulsifiers, water clarifiers, dispersants, emulsion breakers, or any combination thereof.

14. The method as in one of embodiments 1-13, wherein the sulfur-containing molybdenum complex has the general formula III:

Formula III

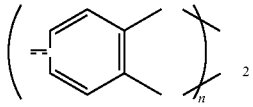

Wherein R represents an oxygen, nitrogen or carbon-containing compounds such as alcohols, alkyl, alkenyl, amides, amines, or aryl groups; n is 2-6.

15. The method as in one of embodiments 1-14, wherein the R or R' comprise each an alkyl group (linear, branched, or cyclic) with or without saturation or heteroatoms or both; thiolates, sulfides, thiocarbamates, thiocarbonates, thioacids, aromatic rings with or without substituents, organic polysulfides, inorganic polysulfides, polymers thereof and combinations thereof.

16. The method as in one of embodiments 1-15, wherein the R or R' comprise each dithiolates, disulfide, dithiolates, dithiocarbamates, dithiocarbonates, dithioacids, inorganic polysulfides, organic polysulfides, polymers thereof and mixtures thereof.

17. The method as in one of embodiments 15-16, wherein the organic polysulfide has the general formula IV:

R2-Sx-R3 Formula IV

Wherein R2 and R3 each represents an oxygen, nitrogen or carbon-containing ligands such as alcohols, alkyl, alkenyl, amides, amines, or aryl groups; and R and R' can be the same or different.

18. The method of embodiment 17, wherein the R2 and R3 comprise each an alkyl group (linear, branched, or cyclic) with or without saturation or heteroatoms or both; thiolates, sulfides, thiocarbamates, thiocarbonates, thioacids, aromatic rings with or without substituents, organic polysulfides, inorganic polysulfides, polymers thereof and combinations thereof.

19. The method as in one of embodiments 17-18, wherein the R2 and R3 comprise each an alkyl group (linear, branched, or cyclic) with or without saturation or heteroatoms or both; thiolates, sulfides, thiocarbamates, thiocarbonates, thioacids, aromatic rings with or without substituents, organic polysulfides, inorganic polysulfides, polymers thereof and combinations thereof.

20. The method as in one of embodiments 1-19, wherein the sulfur-containing molybdenum complex comprises the following:

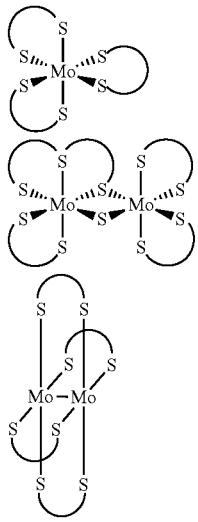

Wherein the arcs represent alkyl chains (linear, branched and cyclic) with or without saturation or heteroatoms or both; thiolates, sulfides, thiocarbamates, thiocarbonates, thioacids, aromatic rings with or without substituents, organic polysulfides, or inorganic polysulfides.

21. The method as in one of embodiments 1-20 wherein the sulfur-containing molybdenum complex provides at least 70% inhibition of foulant deposition.

22. The method as in one of embodiments 1-21, wherein the sulfur-containing molybdenum complex provides at least 70% inhibition of foulant deposition in a SS304 mesh test.

23. The method as in one of embodiments 1-22, wherein the introducing the sulfur-containing molybdenum complex inhibits foulant deposition of a process equipment compared to a process equipment under the same conditions without the introduction of the sulfur-containing molybdenum complex.

24. A composition comprising sulfur-containing molybdenum complex to inhibit deposition of a foulant in contact with process equipment, the sulfur-containing molybdenum complex Formula I Wherein R represents an oxygen, nitrogen or carbon-containing compounds such as alcohols, alkyl, alkenyl, amides, amines, or aryl groups; n is 4-10.

Formula II

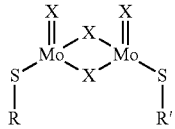

R and R' each represents an oxygen, nitrogen or carbon-containing compounds such as alcohols, alkyl, alkenyl, amides, amines, or aryl groups; and X represents oxygen or sulfur and can be the same or different but where at least one X in the formula is sulfur.

25. The composition of embodiment 24, wherein the composition further comprises one or more, asphaltene inhibitors, paraffin inhibitors, scale inhibitors, emulsifiers, water clarifiers, dispersants, emulsion breakers, or any combination thereof.

26. The composition as in one of embodiments 24-25, wherein the sulfur-containing molybdenum complex has the general formula III:

Formula III

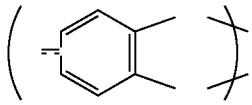

2

Wherein R represents an oxygen, nitrogen or carbon-containing compounds such as alcohols, alkyl, alkenyl, amides, amines, or aryl groups; n is 2-6.

27. The composition as in one of embodiments 24-26, wherein the R, R' comprise each an alkyl group (linear, branched, or cyclic) with or without saturation or heteroatoms or both; thiolates, sulfides, thiocarbamates, thiocarbonates, thioacids, aromatic rings with or without substituents, organic polysulfides, inorganic polysulfides, polymers thereof and combinations thereof.

28. The composition as in one of embodiments 20-27, wherein the R, R' comprise each disulfides, dithiolates, dithiocarbamates, dithiocarbonates, dithioacids, inorganic polysulfides, organic polysulfides, polymers thereof and mixtures thereof.

29. The composition of embodiment 28, wherein the organic polysulfide has the general formula IV:

R2-Sx-R3 Formula IV

Wherein R2 and R3 each represents an oxygen, nitrogen or carbon-containing ligands such as alcohols, alkyl, alkenyl, amides, amines, or aryl groups; and R2 and R3 can be the same or different.

30. The composition of embodiment 29, wherein the R2 and R3 comprise each an alkyl group (linear, branched, or cyclic) with or without saturation or heteroatoms or both; thiolates, sulfides, thiocarbamates, thiocarbonates, thioacids, aromatic rings with or without substituents, organic polysulfides, inorganic polysulfides, polymers thereof and combinations thereof.

31. The composition as in one of embodiments 29-30, wherein the R2 and R3 comprise each an alkyl group (linear, branched, or cyclic) with or without saturation or heteroatoms or both; thiolates, sulfides, thiocarbamates, thiocarbonates, thioacids, aromatic rings with or without substituents, organic polysulfides, inorganic polysulfides, polymers thereof and combinations thereof.

32. The composition as in one of embodiments 24-31, wherein the sulfur-containing molybdenum complex comprises the following:

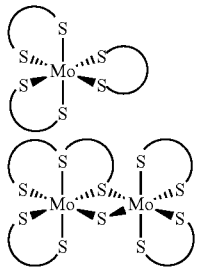

-continued

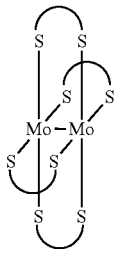

Wherein the arcs represent alkyl chains (linear, branched and cyclic) with or without saturation or heteroatoms or both; thiolates, sulfides, thiocarbamates, thiocarbonates, thioacids, aromatic rings with or without substituents, organic polysulfides, or inorganic polysulfides.

33. The composition as in one of embodiments 24-32, wherein the sulfur-containing molybdenum complex is about 1 ppm to 3000 ppm of the composition.

34. A composition comprising:

a fluid; and the at least one sulfur-containing molybdenum complex as in one of embodiments 24-33.

35. The composition as in one of embodiments 24-34, wherein the fluid is in contact in with coils, heat exchangers, transfer line exchangers quench coolers, furnaces, separation columns or fractionators.

36. The composition as in one of embodiments 24-35, wherein the fluid comprises at least a liquid hydrocarbon fraction.

37. The composition as in one of embodiments 24-36, wherein the hydrocarbon fraction is a distillate.

38. The composition as in one of embodiments 24-37, wherein the fluid temperature is 200° C. to 1500° C.

39. A treated process equipment comprising:

a process equipment comprising a metal surface; and the fluid source comprising the sulfur-containing molybdenum complex as in one of embodiments 24-38, wherein at least a portion of the metal surface is contacted by the fluid source.

40. The treated process equipment of embodiment 39, wherein the process equipment comprises iron or iron alloys.

41. The treated process equipment of embodiment 40, wherein the iron alloys comprise carbon steel, stainless steel, nickel-chromium-iron alloys, or other alloys.

42. The treated process equipment as in one of embodiments 39-41, wherein the metal containment comprises coils, heat exchangers, transfer line exchangers quench coolers, furnaces, separation columns or fractionators.

43. The treated process equipment as in one of embodiments 39-42, wherein the fluid comprises, at least liquid hydrocarbon fraction.

44. Use of the sulfur-containing molybdenum complex as in one of embodiments 1-43 to inhibit foulant deposition.

EXAMPLES

The following examples are intended to illustrate different aspects and embodiments of the application and are not to be considered limiting the scope of the application. It will be recognized that various modifications and changes may be made without following the experimental embodiments described herein, and without departing from the scope of the claims.

Example 1—High Temperature Organic Fouling Inhibition

A sulfur-containing molybdenum complex used as an anti-coke inhibitor was evaluated by gain in weight of SS304 mesh coupons from coke deposition. A reactor apparatus was used to simulate the coking process conditions and temperatures.

Table 1 shows the experimental conditions used in the autoclave testing:

TABLE 1

Experimental Parameters to be used in High Temperature Anti-fouling Testing

| Experimental Variable | Parameter |
|---|---|
| Temperature | 410° C. |
| Reaction N2 pressure | 8 bar @ room temperature |
| Time | 40 minutes |
| Autoclave testing medium | Vacuum distillation bottom residue |
| Metal inserts | SS304 mesh |
| Anticoke dose (continuous process dose) | 1200 ppm |

Anti-Fouling Testing (Continuous Dose Process)

A SS304 mesh (as described above) was weighed on an analytical balance and inserted into a high pressure/high temperature autoclave vessel. Then, 50 g vacuum distillation bottom residue was added into the autoclave. Subsequently, the vessel was closed and sealed. The vessel was purged and pressurized with N2. The reactor content was continuously mixed while the vessel was heating to 410° C. Once the target temperature of 410° C. was reached of the medium, the pyrolysis experiment time was started.

At the end of the reaction time of about 40 minutes, the autoclave was cooled down and the reactor pressure was released. Subsequently, the mesh was removed from the reactor and washed with toluene. The weight increase was measured, and the weight gain was calculated.

FIG. 1 shows the response for Test Complex A (molybdenum dithiocarbamate) compared to Comparative Complex 1 (formaldehyde resin) and Comparative Complex 2 (olefinic copolymer) for the tested residual deposition amounts. The repeatability of the pyrolysis experiments in the mentioned reactors is ±1 mg. FIG. 1 also shows that Test Complex A was equal or better than the comparative complex chemistries. The Test Complex A and Comparative Complex 1 reduced the surface coke deposition to a similar extent with the current residue feed sample when they are used as anti-coke chemistries.

Example 2—High Temperature Organic Fouling Inhibition (Prophetic)

The sulfur-containing molybdenum complexes used as anti-coke inhibitors will be evaluated by gain in weight of SS304 mesh coupons from coke deposition in a pre-passivation dose. A reactor apparatus will be used to simulate the coking process conditions and temperatures.

Table 2 shows the experimental conditions that will be used in the autoclave testing:

TABLE 2

Experimental Parameters to be used in High Temperature Anti-fouling Testing

| Experimental Variable | Parameter |
|---|---|
| Temperature | 410° C. |
| Shear rate | 600 rpm after the temperature reaches 410° C. |
| Reaction $N_2$ pressure | 8 bar @ room temperature |
| Time | 40 minutes |
| Autoclave testing medium | Vacuum distillation bottom residue (e.g., heavy content of petroleum) |
| Metal inserts | SS304 mesh |
| Pre-passivation dose | 1000 ppm |

Mesh Prepassivation Step 500 mL of paraffin oil solution will be placed in a 1 L glass reactor and heated to 250° C.

Metal meshes will be first weighed on an analytical balance (four-decimal). Next the meshes will be immersed in paraffin oil that will be heated at 250° C. and subjected to continuous nitrogen purging. To the heated oil will be added 1000 ppm dose of an anti-foulant composition tested and the resulting paraffin oil solution will be stirred at 250° C. for 1 hour. This heating and introducing the test anti-foulant simulates the process as a real unit in which the passivator would be applied over a short time frame (12 to 24 hours) at a high concentration in a hydrocarbon medium during the warm up of equipment. After 1-hour of passivation, heating will be stopped. Once the oil cooled down (<80° C.), the meshes will be removed from the oil, will be washed with toluene and isopropanol, and dried using a nitrogen gas stream.

A prepassivated SS304 mesh (as described above) will be weighed on an analytical balance (four-decimal) and inserted into a high pressure/high temperature autoclave vessel. Then, 50 g vacuum distillation bottom residue or any other kind of hydrocarbon stream will be added into the autoclave. Subsequently, the vessel will be sealed and tightened using a set of bolts/screws. The atmosphere inside the vessel will be first purged with N2 using three rounds of 100 psi N2 fills/releases. The vessel will be then pressurized with N2 to 100 psi and then inserted inside a heating element or mantle. The reactor content will be continuously mixed while the vessel will be heating to 410° C. Once the target temperature of 410° C. will be reached, the pyrolysis experiment time will be started.

Subsequently, the autoclave will be cooled down to 350° C., the pressure inside the vessel will be released, and then purged with N2. Next, the heating mantle will be turned off and the vessel temperature dropped below 150° C., the autoclave will be removed from the heating mantle and disassembled and the mesh will be removed and will washed with toluene. The dried mesh will be weighed using the same analytical balance used to initially weight prepassivated SS304 mesh, and the weight gain will be calculated.

The compounds to be tested based on the procedure described above will be Test Complexes such as a sulfur-containing Mo thiolate; a sulfur-containing Mo dialkyldithiocarbamate; a sulfur-containing Mo dialkyldithiocarbonate; a sulfur-containing Mo dialkyldithioacid and a sulfur-containing Mo polysulfide and will be compared to Comparative Complexes such as a mixture of a mono- and di-alkyl phosphate ester or an organic polysulfide or an inorganic polysulfide; or a thiolate or other benchmark anti-coke chemistries such as magnesium-based products and Test Complex A, Comparative Complex 1 and 2 as described in Example 1.

The application illustratively disclosed herein can be suitably practiced in the absence of any element which is not specifically disclosed herein. Additionally, each and every embodiment of the application, as described herein, is intended to be used either alone or in combination with any other embodiment described herein as well as modifications, equivalents, and alternatives thereof. In various embodiments, the application suitably comprises, consists essentially of, or consists of the elements described herein and claimed according to the claims. It will be recognized that various modifications and changes may be made without following the example embodiments and applications illustrated and described herein, and without departing from the scope of the claims.

What is claimed is:

1. A method of inhibiting deposition of a foulant in a metal containment contacted by a hydrocarbon fluid containing the foulant, comprising the step of introducing an antifouling composition into the metal equipment or the hydrocarbon fluid, wherein the antifouling composition comprises a sulfur-containing molybdenum fouling inhibitor having the general formula selected from Formula I:

Formula I

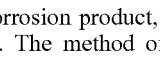

wherein R of Formula I represents a group selected from the group consisting of an alcohol group, an alkyl group, an alkenyl group, or an aryl group; and n of Formula I is 4-10.

2. The method of claim 1, wherein the introducing is carried out after or during a decoking or cleaning or during a warm up process.

3. The method of claim 1, wherein the introducing is carried out continuously.

4. The method of claim 1, wherein the foulant comprises a foulant selected from the group consisting of coke, sludge, a corrosion product, a polymer, or catalyst fines.

5. The method of claim 1, wherein the introducing is carried out intermittently.

6. The method of claim 1, wherein R is phosphorus free.

* * * * *